US008552957B2

(12) United States Patent
Hotelling

(10) Patent No.: US 8,552,957 B2
(45) Date of Patent: Oct. 8, 2013

(54) LIQUID CRYSTAL DISPLAY REORDERED INVERSION

(75) Inventor: Steven Porter Hotelling, San Jose, CA (US)

(73) Assignee: Apple Inc., Cupertino, CA (US)

( * ) Notice: Subject to any disclaimer, the term of this patent is extended or adjusted under 35 U.S.C. 154(b) by 655 days.

(21) Appl. No.: 12/545,763

(22) Filed: Aug. 21, 2009

(65) Prior Publication Data

US 2010/0195004 A1 Aug. 5, 2010

Related U.S. Application Data

(60) Provisional application No. 61/149,291, filed on Feb. 2, 2009.

(51) Int. Cl.
*G09G 5/36* (2006.01)

(52) U.S. Cl.
USPC ..... 345/100; 345/82; 345/92; 345/212; 345/96; 345/87

(58) Field of Classification Search
None
See application file for complete search history.

(56) References Cited

U.S. PATENT DOCUMENTS

| | | | | |
|---|---|---|---|---|
| 3,568,070 | A * | 3/1971 | Kaps et al. | 377/44 |
| 5,483,261 | A | 1/1996 | Yasutake | |
| 5,488,204 | A | 1/1996 | Mead et al. | |
| 5,825,352 | A | 10/1998 | Bisset et al. | |
| 5,835,079 | A | 11/1998 | Shieh | |
| 5,880,411 | A | 3/1999 | Gillespie et al. | |
| 6,014,120 | A * | 1/2000 | Chiu et al. | 345/82 |
| 6,072,457 | A * | 6/2000 | Hashimoto et al. | 345/100 |
| 6,140,990 | A * | 10/2000 | Schlig | 345/92 |
| 6,188,391 | B1 | 2/2001 | Seely et al. | |
| 6,310,610 | B1 | 10/2001 | Beaton et al. | |
| 6,323,846 | B1 | 11/2001 | Westerman et al. | |
| 6,384,807 | B1 * | 5/2002 | Furuhashi et al. | 345/96 |
| 6,469,684 | B1 * | 10/2002 | Cole | 345/58 |
| 6,690,387 | B2 | 2/2004 | Zimmerman et al. | |
| 6,750,842 | B2 * | 6/2004 | Yu | 345/102 |
| 7,015,894 | B2 | 3/2006 | Morohoshi | |
| 7,184,064 | B2 | 2/2007 | Zimmerman et al. | |
| 7,710,377 | B2 | 5/2010 | Kang et al. | |
| 7,889,303 | B2 * | 2/2011 | Onogi et al. | 349/141 |
| 7,990,120 | B2 * | 8/2011 | Leonard et al. | 323/282 |

(Continued)

FOREIGN PATENT DOCUMENTS

| | | |
|---|---|---|
| EP | 0 945 844 A2 | 9/1999 |
| EP | 1 414 011 A1 | 4/2004 |

(Continued)

OTHER PUBLICATIONS

European Search Report mailed May 10, 2010, for EP Application No. 10151967.6, seven pages.

(Continued)

*Primary Examiner* — Van Chow
(74) *Attorney, Agent, or Firm* — Morrison & Foerster LLP

(57) ABSTRACT

Methods and apparatus for switching the voltages supplied to the electrodes of pixels disposed within a liquid crystal display device. By reducing the frequency associated with an alternating voltage supplied to a first set of liquid crystal electrodes, the power required to drive the liquid crystal display device can be reduced. At the same time, a reordered schedule for updating rows of pixels in the liquid crystal display device can provide improved image quality.

19 Claims, 11 Drawing Sheets

(56) References Cited

U.S. PATENT DOCUMENTS

| | | | | |
|---|---|---|---|---|
| 8,031,153 | B2 * | 10/2011 | Kang et al. | 345/96 |
| 2001/0040569 | A1 * | 11/2001 | Liang | 345/212 |
| 2003/0090448 | A1 * | 5/2003 | Tsumura et al. | 345/87 |
| 2003/0169247 | A1 * | 9/2003 | Kawabe et al. | 345/204 |
| 2004/0070559 | A1 * | 4/2004 | Liang | 345/87 |
| 2004/0263502 | A1 | 12/2004 | Dallas et al. | |
| 2005/0174310 | A1 | 8/2005 | Huang et al. | |
| 2005/0264474 | A1 | 12/2005 | Rast | |
| 2006/0026521 | A1 | 2/2006 | Hotelling et al. | |
| 2006/0097991 | A1 | 5/2006 | Hotelling et al. | |
| 2006/0176266 | A1 | 8/2006 | Pak et al. | |
| 2006/0197753 | A1 | 9/2006 | Hotelling | |
| 2007/0222907 | A1 * | 9/2007 | Onogi et al. | 349/42 |
| 2008/0030178 | A1 * | 2/2008 | Leonard et al. | 323/282 |
| 2008/0231573 | A1 * | 9/2008 | Goto et al. | 345/87 |
| 2008/0284929 | A1 | 11/2008 | Kimura | |
| 2008/0303836 | A1 | 12/2008 | Ludden et al. | |
| 2009/0027364 | A1 | 1/2009 | Kwan et al. | |
| 2009/0189881 | A1 * | 7/2009 | Ooishi et al. | 345/211 |
| 2010/0097366 | A1 | 4/2010 | Kitayama et al. | |
| 2010/0195004 | A1 * | 8/2010 | Hotelling | 348/792 |
| 2011/0298783 | A1 * | 12/2011 | Oh et al. | 345/212 |

FOREIGN PATENT DOCUMENTS

| | | | |
|---|---|---|---|
| JP | 2000-163031 | A | 6/2000 |
| JP | 2002-342033 | A | 11/2002 |
| JP | 2005-301373 | A | 10/2005 |
| JP | 2006-018299 | A | 1/2006 |
| JP | 2006-524365 | A | 10/2006 |
| WO | WO-2004/095404 | A2 | 11/2004 |
| WO | WO-2008/139693 | A1 | 11/2008 |
| WO | WO-2010/088655 | A1 | 8/2010 |

OTHER PUBLICATIONS

Lee, S.K. et al. (Apr. 1985). "A Multi-Touch Three Dimensional Touch-Sensitive Tablet," *Proceedings of CHI: ACM Conference on Human Factors in Computing Systems*, pp. 21-25.

Rubine, D.H. (Dec. 1991). "The Automatic Recognition of Gestures," CMU-CS-91-202, Submitted in Partial Fulfillment of the Requirements of the Degree of Doctor of Philosophy in Computer Science at Carnegie Mellon University, 285 pages.

Rubine, D.H. (May 1992). "Combining Gestures and Direct Manipulation," CHI '92, pp. 659-660.

Westerman, W. (Spring 1999). "Hand Tracking, Finger Identification, and Chordic Manipulation on a Multi-Touch Surface," A Dissertation Submitted to the Faculty of the University of Delaware in Partial Fulfillment of the Requirements for the Degree of Doctor of Philosophy in Electrical Engineering, 364 pages.

International Search Report mailed Apr. 20, 2010, for PCT/US10/22862, filed Feb. 2, 2010, two pages.

* cited by examiner

Frame0
Frame1
Row0 Row2 Row1 Row3
Row0 Row2 Row1 Row3
4.5V
0.5V
4V
1V
4V
1V
VCOM
Data(Black)
Data(White)
Data0 Data2 Data1 Data3
Data0 Data2 Data1 Data3
Gate0
Gate1
Gate2
Gate3
+0.5V
-0.5V
+3.5V
-3.5V
Vtft0(Black)
Vtft1(Black)
Vtft2(Black)
Vtft3(Black)
Vtft0(White)
Vtft1(White)
Vtft2(White)
Vtft3(White)

Black

Frame0

| | | | | |
|---|---|---|---|---|
| Row0 | +0.5 | +0.5 | +0.5 | +0.5 |
| Row1 | -0.5 | -0.5 | -0.5 | -0.5 |
| Row2 | +0.5 | +0.5 | +0.5 | +0.5 |
| Row3 | -0.5 | -0.5 | -0.5 | -0.5 |

Frame1

| | | | | |
|---|---|---|---|---|
| Row0 | -0.5 | -0.5 | -0.5 | -0.5 |
| Row1 | +0.5 | +0.5 | +0.5 | +0.5 |
| Row2 | -0.5 | -0.5 | -0.5 | -0.5 |
| Row3 | +0.5 | +0.5 | +0.5 | +0.5 |

White

Frame0

| | | | | |
|---|---|---|---|---|
| Row0 | +3.5 | +3.5 | +3.5 | +3.5 |
| Row1 | -3.5 | -3.5 | -3.5 | -3.5 |
| Row2 | +3.5 | +3.5 | +3.5 | +3.5 |
| Row3 | -3.5 | -3.5 | -3.5 | -3.5 |

Frame1

| | | | | |
|---|---|---|---|---|
| Row0 | -3.5 | -3.5 | -3.5 | -3.5 |
| Row1 | +3.5 | +3.5 | +3.5 | +3.5 |
| Row2 | -3.5 | -3.5 | -3.5 | -3.5 |
| Row3 | +3.5 | +3.5 | +3.5 | +3.5 |

FIG. 3F

Row Writing Sequences (left to right)

| | | | | | | | | | | | | | | | | |
|---|---|---|---|---|---|---|---|---|---|---|---|---|---|---|---|---|
| 1 Row Inversion VCOM | 0 | 1 | 0 | 1 | 0 | 1 | 0 | 1 | 0 | 1 | 0 | 1 | 0 | 1 | 0 | 1 |
| 1 Row Inversion ROW | 0 | 1 | 2 | 3 | 4 | 5 | 6 | 7 | 8 | 9 | 10 | 11 | 12 | 13 | 14 | 15 |

FIG. 4A (Prior Art)

| | | | | | | | | | | | | | | | | |
|---|---|---|---|---|---|---|---|---|---|---|---|---|---|---|---|---|
| 2 Row Re-Ordered VCOM | 0 | 0 | 1 | 1 | 0 | 0 | 1 | 1 | 0 | 0 | 1 | 1 | 0 | 0 | 1 | 1 |
| 2 Row Re-Ordered ROW | 0 | 2 | 1 | 3 | 4 | 6 | 5 | 7 | 8 | 10 | 9 | 11 | 12 | 14 | 13 | 15 |

FIG. 4B

| | | | | | | | | | | | | | | | | |
|---|---|---|---|---|---|---|---|---|---|---|---|---|---|---|---|---|
| 4 Row Re-Ordered VCOM | 0 | 0 | 0 | 0 | 1 | 1 | 1 | 1 | 0 | 0 | 0 | 0 | 1 | 1 | 1 | 1 |
| 4 Row Re-Ordered ROW | 0 | 2 | 4 | 6 | 1 | 3 | 5 | 7 | 8 | 10 | 12 | 14 | 9 | 11 | 13 | 15 |

FIG. 4C

| | | | | | | | | | | | | | | | | |
|---|---|---|---|---|---|---|---|---|---|---|---|---|---|---|---|---|
| 8 Row Re-Ordered VCOM | 0 | 0 | 0 | 0 | 0 | 0 | 0 | 0 | 1 | 1 | 1 | 1 | 1 | 1 | 1 | 1 |
| 8 Row Re-Ordered DATA | 0 | 2 | 4 | 6 | 8 | 10 | 12 | 14 | 1 | 3 | 5 | 7 | 9 | 11 | 13 | 15 |

FIG. 4D

LIQUID CRYSTAL DISPLAY REORDERED INVERSION

CROSS REFERENCE TO RELATED APPLICATIONS

This application claims benefit of U.S. Provisional Application No. 61/149,291 filed Feb. 2, 2009, the contents of which are incorporated by reference herein in their entirety for all purposes.

FIELD OF THE DISCLOSURE

Embodiments of the present disclosure relate generally to the field of liquid crystal display devices. More particularly, embodiments of the present disclosure are directed in one exemplary aspect to methods of updating rows of pixels in liquid crystal display devices.

BACKGROUND OF THE DISCLOSURE

Conventional liquid crystal displays are often made up of a number of color or monochrome pixels filled with liquid crystal molecules and arranged in front of a light source (such as a backlight) or a light reflector. Each addressable pixel of the display includes a liquid crystal element arranged proximate to two electrodes. By setting a voltage between the two electrodes, the strength of an electric field between the electrodes is changed. The strength of this electric field causes molecules within a liquid crystal element to assume a specific orientation relative to the electric field (i.e., either parallel or perpendicular to the electric field, or at some angle in between). When combined with suitably oriented polarizers, a liquid crystal element effectively acts as a shutter, allowing a certain amount of light to pass out of the display at a respective pixel. Thus, by adjusting the voltage between the two electrodes, the display can produce various levels of grey (or in the case of color, various levels of red, green, or blue).

If the voltage between the two electrodes is held constant for an extended period of time, a phenomenon known as "image sticking" can occur. Image sticking is a result of a parasitic charge build-up within liquid crystals that prevents the liquid crystals from returning to their normal state after the voltage applied to the electrodes is changed. This can cause charged crystal alignment at the bottom or top of a particular sub-pixel, or even a crystal migration toward the edge of the sub-pixel. The net effect of image sticking is that a faint outline of a previously displayed image can remain on the display screen even after the image is changed. This effect is therefore undesirable.

Conventional inversion techniques correct this phenomenon by periodically switching the polarity of the voltage applied between the two electrodes. However, some of these inversion techniques yield image degradation and/or flicker, while others require hardware capable of supplying large output voltage ranges or otherwise require a high frequency of alternating voltage. For this reason, conventional inversion techniques often require a large amount of power to implement.

SUMMARY OF THE DISCLOSURE

Various embodiments of the present disclosure are directed to methods for switching the voltages supplied to the electrodes of pixels disposed within a liquid crystal display device. By reducing the frequency associated with an alternating voltage supplied to a first set of liquid crystal electrodes, the power required to drive the liquid crystal display device can be reduced. At the same time, a reordered schedule for updating rows of pixels in the liquid crystal display device can provide improved image quality (i.e., without perceptible flicker and/or image tearing).

BRIEF DESCRIPTION OF THE DRAWINGS

FIG. 3F is a diagram illustrating tables of exemplary relative voltages of liquid crystal capacitors during a two row reordered method of inversion according to embodiments of the disclosure.

FIG. 4A is a table illustrating an exemplary row sequence for conventional 1 row inversion.

FIG. 4B is a table illustrating an exemplary row sequence for a two row reordered inversion according to embodiments of the disclosure.

FIG. 4C is a table illustrating an exemplary row sequence for a four row reordered inversion according to embodiments of the disclosure.

FIG. 4D is a table illustrating an exemplary row sequence for an eight row inversion according to embodiments of the disclosure.

DETAILED DESCRIPTION OF THE EXEMPLARY EMBODIMENTS

In the following description of exemplary embodiments, reference is made to the accompanying drawings in which it is shown by way of illustration specific embodiments in which embodiments of the disclosure can be practiced. It is to be understood that other embodiments can be used and structural changes can be made without departing from the scope of the embodiments of the disclosure.

Various embodiments of the present disclosure are directed to methods for switching the voltages supplied to the electrodes of pixels disposed within a liquid crystal display device. By reducing the frequency associated with an alternating voltage supplied to a first set of liquid crystal electrodes, the power required to drive the liquid crystal display device can be reduced. At the same time, a reordered schedule for updating rows of pixels in the liquid crystal display device can provide improved image quality (i.e., without perceptible flicker and/or image tearing).

Although embodiments of the disclosure may be described and illustrated herein in terms of methods for creating a reordered sequence of row updates within a display panel, it should be understood that embodiments of the disclosure are not so limited, but are additionally applicable to methods for initially updating the rows within a display panel according to a pre-specified order. That is to say, some embodiments of the present disclosure do not require a stream of data corresponding to a sequential row update schedule to be reordered so as to match a non-sequential row update schedule. Instead, logic can be utilized which initially outputs the stream of data according to the non-sequential row update schedule, thereby obviating the need for separate reordering logic.

Furthermore, although embodiments of the disclosure may be described and illustrated herein in terms of logic performed within a host video driver, it should be understood that embodiments of the disclosure are not so limited, but can also be performed within a display subassembly, liquid crystal display driver chip, or within another module in any combination of software, firmware, and/or hardware.

Figure 1:
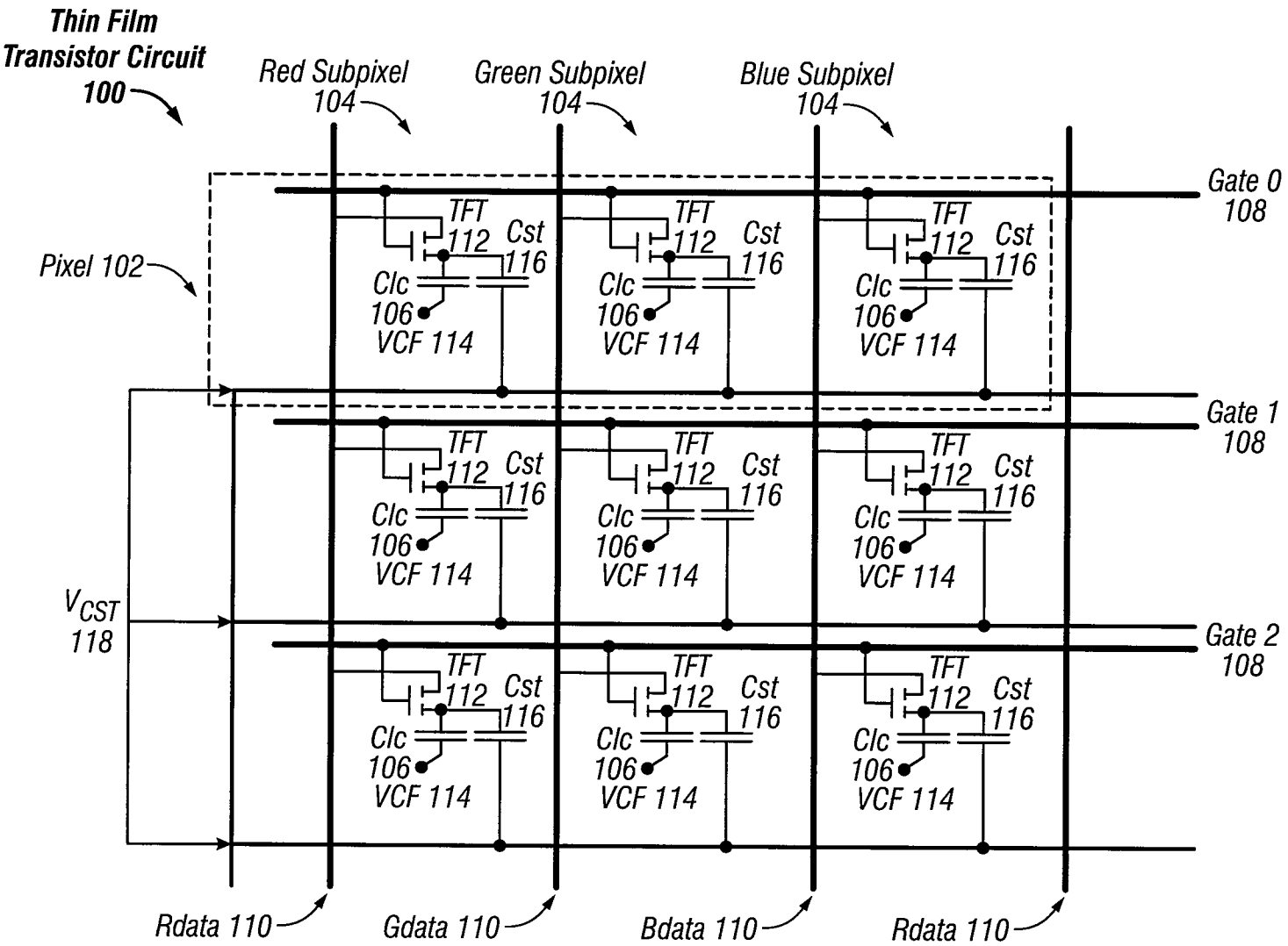
FIG. 1 illustrates a portion of an exemplary thin film transistor circuit according to embodiments of the present disclosure.

FIG. 1 illustrates a portion of an exemplary thin film transistor circuit 100 according to embodiments of the present disclosure. As shown by the figure, the thin-film transistor circuit 100 includes a plurality of pixels 102 arranged into rows, with each pixel 102 containing a set of color sub-pixels 104 (red, green, and blue, respectively). Each color reproducible by the liquid crystal display can therefore be a combination of three levels of light emanating from a particular set of color sub-pixels 104.

Each color sub-pixel 104 may include two electrodes that form a capacitor with the liquid crystal serving as a dielectric. This is shown as a liquid crystal capacitor 106 (denoted here as $C_{lc}$) in FIG. 1. Liquid crystal molecules situated between the two electrodes may rotate in the presence of a voltage to form a twisted molecular structure that can change the polarization angle of incident polarized light coming from the backlight to a first polarizer, for example. The net amount of change in polarization depends on the magnitude of the voltage, which can be adjusted to vary the degree of alignment of the polarization angle of the incident light with respect to a polarization angle of a second polarizer. Depending on the type of liquid crystal display, when a voltage is applied across the electrodes, a torque acts to align (twist or untwist) the liquid crystal molecules in a direction parallel or perpendicular to the electric field. In sum, by controlling the voltage applied across the electrodes, light can be allowed to pass through a particular color sub-pixel 104 in varying amounts.

In conventional thin film transistor active matrix-type displays, a plurality of scan lines (called gate lines 108) and a plurality of data lines 110 may be formed in the horizontal and vertical directions, respectively. Each sub-pixel may include a thin film transistor (TFT) 112 provided at the respective intersection of one of the gate lines 108 and one of the data lines 110. A row of sub-pixels may be addressed by applying a gate signal on the row's gate line 108 (to turn on the TFTs of the row), and by applying voltages on the data lines 110 corresponding to the amount of emitted light desired for each sub-pixel in the row. The voltage level of each data line 110 may be stored in a storage capacitor 116 in each sub-pixel to maintain the desired voltage level across the two electrodes associated with the liquid crystal capacitor 106 relative to a color filter voltage source 114 (denoted here as $V_{cf}$). Note that if the associated color sub-pixel 104 is an in-plane switching (IPS) device, the color filter voltage source 114 can be provided, for example, by a fringe field electrode connected to a common voltage line. Alternatively, if the associated color sub-pixel 104 does not utilize in-plane switching (non-IPS), the color filter voltage source 114 can be provided, for example, through a layer of indium tin oxide patterned upon a color filter glass.

Storage capacitor 116 (denoted here as $C_{st}$) may also help to reduce the variability in the desired voltage level of the sub-pixels caused by variations in the characteristics of thin film transistors 112 or due to variations in liquid crystal elements associated with the liquid crystal capacitors 106. A set of capacitor voltage lines 118 (denoted here as $V_{cst}$) running horizontally across the thin film transistor circuit 100 and parallel to the gate lines 108 may be used to charge each of the storage capacitors 116. The capacitor voltage lines 118 are typically tied together and to the color filter voltage source 114.

Figure 2:
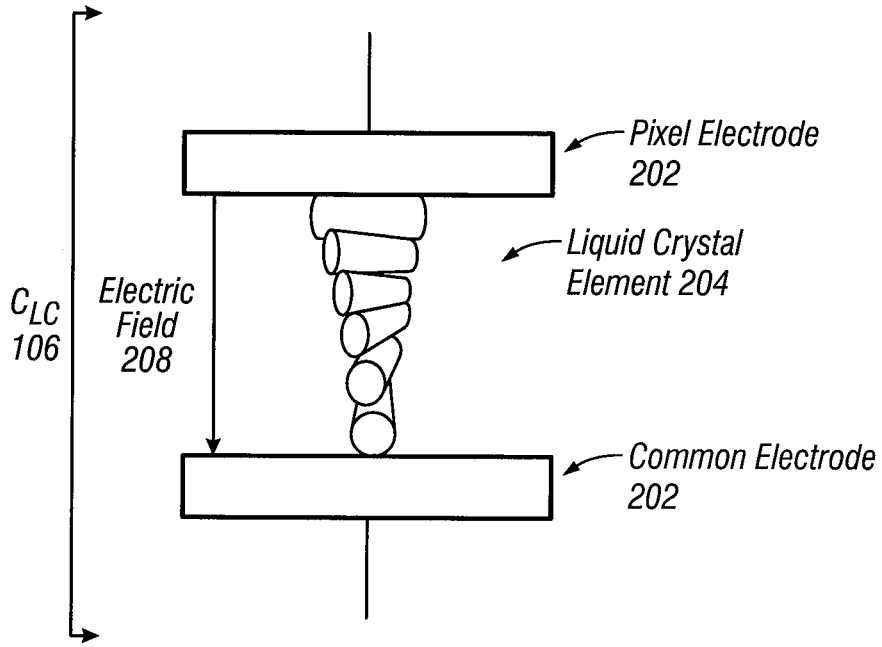
FIG. 2 is a diagram of an exemplary liquid crystal capacitor according to embodiments of the present disclosure.

FIG. 2 is a diagram of an exemplary liquid crystal capacitor 106 according to embodiments of the present disclosure. As shown by the figure, the liquid crystal capacitor 106 can contain a liquid crystal element 204 (which may include, for example, a series of liquid crystal molecules) situated between two electrodes. During normal operation, an electric field 208 may be generated based upon the relative voltage between the top electrode (denoted in FIG. 2 as pixel electrode 202) and the bottom electrode (denoted in FIG. 2 as common electrode 206). The amount that a liquid crystal element 204 rotates (twist or untwist) depends on the strength of the electric field 208, which in turn depends upon the relative voltage between the electrodes 202 and 206.

If the voltage between the two electrodes is held constant for an extended period of time (for example, as by a DC bias), a phenomenon known as "image sticking" can occur. Image sticking is a result of a parasitic charge build-up (polarization) within the liquid crystals that prevents the liquid crystals from returning to their normal state after the voltage applied to the electrodes is changed. This can cause charged crystal alignment at the bottom or top of a sub-pixel 104, or even a crystal migration toward the edge of the sub-pixel 104. The net effect of image sticking is that a faint outline of a previously displayed image can remain on the display screen even after the image is changed. This effect is therefore undesirable.

One general strategy for reducing the effects of image sticking in liquid crystal display devices is to maintain an average DC voltage of zero volts across a liquid crystal capacitor 106 by periodically switching the polarity of the relative voltage between the electrodes of the liquid crystal capacitor. For example, if a total relative voltage magnitude of three volts is required to produce a certain amount of twist to a liquid crystal element 204, this might be achieved by switching voltages of the electrodes 202 and 206 so that the relative voltage between the electrodes 202 and 206 alternates between positive three volts and negative three volts during subsequent video frames.

Unfortunately, many conventional implementations of such voltage switching, i.e., inversion, strategy run into the two competing design tradeoffs of image quality (flicker) versus power consumption. For example, consider the case of the conventional method of frame inversion where the voltage applied to the common electrodes 206 is switched with each successive video frame.

On the one hand, frame inversion can consume relatively low power since only a single voltage transition is required per each frame update. On the other hand, voltage switching between successive video frames may yield optical asymmetries due to minute errors in the LCD driver chip, asymmetries in the thin film transistors, charge indirection, and due to the thin film transistor switches otherwise possessing imperfect properties. In many cases, the same pixels within successive video frames can appear at different brightness levels (for example, during a first video frame, the percentage of brightness for any given pixel of the display may be 50%, while during the next frame, the percentage of brightness for the same pixel may be 52%). While the difference between brightness levels produced by the same pixel between successive frames may be relatively small, the human eye can nevertheless perceive flicker since each pixel of the display is rapidly alternating between brighter and darker levels (i.e., according to the voltage level of $V_{com}$).

The problem of flicker can occur in inversion methods in which adjacent rows of pixels are updated before the voltage level applied to the electrodes is switched. In conventional frame inversion methods, for example, all of the pixel rows are maintained at a first voltage during a given video frame, and all are switched to a second voltage during the next video frame.

Conventional one row inversion methods, in which adjacent pixel rows are maintained at different voltage levels and switched in subsequent frames, can provide better image quality with reduced flicker. In particular, updating the rows sequentially and inverting $V_{com}$ for each row may mitigate optical asymmetries because half of the rows of pixels on the display screen are behaving differently than the other half of the rows for any given video frame. More specifically, during a single video frame, the even rows may become slightly brighter, while the odd rows may become slightly darker, with the relationship reversing for the next video frame. Thus, the human eye may not perceive flicker since the average display intensity remains constant across all video frames.

However, inverting $V_{com}$ as each row of the display panel is updated can consume a relatively large amount of power when compared, for example, with a conventional frame inversion method. This is because power is directly related to current, while current is directly related to frequency. More specifically:

$$P=I\cdot V, \text{ and}$$

$$I=C_{TOT}\cdot f\cdot V_{PP}$$

Thus, by increasing the frequency f associated with row updates, the current I is therefore increased resulting in a higher power output P. In one row inversion, for example, the number of times $V_{com}$ is switched during a given frame is equal to the total number of pixel rows within the display panel. In contrast, frame inversion requires $V_{com}$ to be switched only once per frame and therefore requires substantially less power.

Thus, a design tradeoff of flicker versus power consumption exists between, for example, conventional frame inversion and one row inversion. Note that this design tradeoff of flicker versus power consumption constrains other conventional inversion techniques as well. For example, in conventional two row inversion, two rows of pixels may be updated before the voltage levels of $V_{com}$ are switched. Thus, the frequency of two row inversion may be one-half of the frequency of one row inversion, resulting in a significantly smaller rate of power consumption.

Despite the power savings associated with the lower frequency, however, asymmetrical visual artifacts can be perceptible within the video feed. This is because pairs of adjacent rows are updated with each transition of $V_{com}$. That is to say, unlike the case of one row inversion where all rows that are adjacent to any given row may exhibit a level of brightness that is darker (or lighter) than that particular row, in the case of two row inversion, pairs of adjacent rows become brighter and darker simultaneously. Thus, the flicker-effect may be more perceptible with two row inversion than it is with one row inversion. Note also that as more rows are updated before the voltage level of $V_{com}$ is switched (for example, four row inversion where sets of four rows are updated, eight row inversion where sets of eight rows are updated, etc.), the amount of power necessary to implement the inversion becomes progressively smaller, while the amount of flicker perceptible may become progressively more noticeable.

Various embodiments of the present disclosure therefore serve to maintain the spatial characteristics of one row inversion (i.e., preserve high image quality without perceptible flicker) while simultaneously reducing the $V_{com}$ inversion frequency in order to conserve power. In some embodiments this may be accomplished using a single voltage source for driving all of the common electrodes 206 of the display panel instead of independently switching multiple $V_{coms}$.

Embodiments of the present disclosure may be implemented in a wide variety of ways. For example, according to one embodiment, each row of pixels in the display panel may be assigned to an update set such that any given row in the set is separated from a subsequent row in the set by at least one row. A common voltage may be applied electrodes in the display panel, wherein the applied voltage is adapted to switch between two voltage levels at a constant frequency. Pixels in the rows of an update set may then be updated each time the voltage applied to the electrodes switches voltage levels.

In this manner, the effects of flicker may be mitigated since there are no clusters of adjacent rows updated during a single transition of $V_{com}$. Additionally, since the $V_{com}$ inversion frequency is smaller than the inversion frequency associated with conventional one row inversion, less power may be required than that necessary for conventional one row inversion.

FIGS. 3A-3E are diagrams illustrating various waveforms associated with an exemplary method of implementing reordered inversion according to embodiments of the present disclosure. Note that while a two row method of reordered inversion is shown generally with respect to FIGS. 3A-3F, this process can be readily extended to utilize a larger number of rows according to embodiments of the present disclosure (including, without limitation, a four row reordered method, an eight row reordered method, a sixteen row reordered method, a thirty-two row reordered method, and a sixty-four row reordered method).

Figures 3A, 3B, 3C, 3D, 3E:
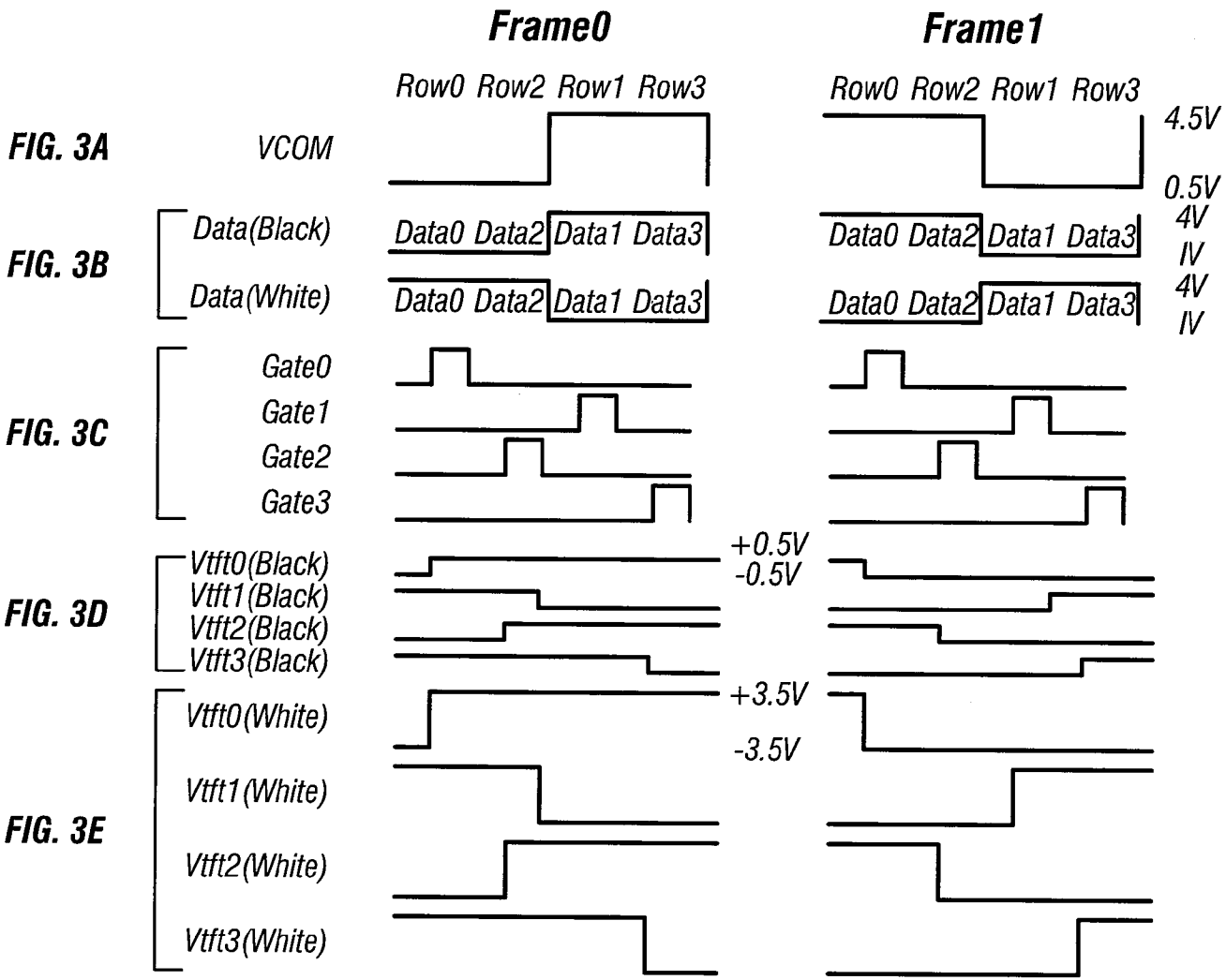
FIG. 3A is a diagram illustrating an exemplary common voltage waveform associated with a two row reordered method of inversion according to embodiments of the disclosure.
FIG. 3B is a diagram illustrating exemplary data voltage waveforms associated with a two row reordered method of inversion according to embodiments of the disclosure.
FIG. 3C is a diagram illustrating exemplary gate pulse sequences associated with a two row reordered method of inversion according to embodiments of the disclosure.
FIG. 3D is a diagram illustrating exemplary relative voltage waveforms with respect to a black data source associated with a two row reordered method of inversion according to embodiments of the disclosure.
FIG. 3E is a diagram illustrating exemplary relative voltage waveforms with respect to a white data source associated with a two row reordered method of inversion according to embodiments of the disclosure.

FIG. 3A is a diagram illustrating a waveform associated with an exemplary method of switching the voltages applied to common electrodes ($V_{com}$) according to embodiments of the present disclosure. As shown by the figure, two rows of pixels may be updated per each transition of $V_{com}$. Since twice as many rows may be updated with each transition of $V_{com}$ as in the case of conventional one row inversion, the number of $V_{com}$ transitions necessary to update all of the rows within the display may therefore be one-half of the number of transitions necessary for conventional one row inversion. Thus, the inversion frequency may be one-half as large as the frequency associated with conventional one row inversion, and therefore less power may be necessary to drive the display.

FIG. 3B is a diagram illustrating a set of waveforms associated with voltages applied to pixel electrodes 202. A first waveform illustrates the voltage applied over a first data line 110 (DATA (black)) as a function of time, while a second waveform illustrates the voltage applied over a second data line 110 (DATA (white)) as a function of time. A particular pixel 102 within the thin film transistor circuit 100 may produce a specific level of brightness based upon the voltage levels applied to the pixel electrodes 202 in corresponding black and white sub-pixels. In the example illustrated in FIGS. 3A-3E, the particular brightness output for each pixel is generated by achieving a relative voltage with a magnitude of 0.5 volts with respect to a black sub-pixel, and 3.5 volts with respect to a white sub-pixel.

The particular voltage settings for the black and white data lines 110 may be determined based upon the desired relative voltage between the pixel electrodes 202 and the common electrodes 206 at a particular moment in time. Thus, if a target relative voltage of +0.5 volts is desired when the voltage level of $V_{com}$ is equal to +0.5 volts (relative to ground), then the voltage applied to the corresponding data line 110 may be +1.0 volts. Similarly, if a target relative voltage of +3.5 volts is desired when the voltage level of $V_{com}$ is equal to +0.5 volts (relative to ground), then the voltage applied to the corresponding data line 110 the data line may be +4.0 volts.

Note that even though two rows may be updated with each transition of $V_{com}$ (as in the case of conventional two row inversion), the order in which the rows are selected may be non-sequential according to embodiments of the disclosure. More specifically, the rows may be selected in a non-sequential order so as to minimize the number of clusters of adjacent rows that are updated during the same transition of $V_{com}$. For example, as shown in FIG. 3A, the first set of rows selected (the update set) may contain row zero and row two, while the second update set may contain row one and row three. Thus, each row in the update set may be separated from the next row in the set by a commonly adjacent row that updated after the voltage level of $V_{com}$ is switched.

In order to select the rows in this particular sequence, the gate pulse sequences may be reordered according to embodiments of the present disclosure. For example, FIG. 3C illustrates a reordered set of gate pulse sequences which may be used to select row zero and row two within the first update set, and row one and row three in the second update set. The gate indices may correspond to a particular row within the display panel. Thus, to select row zero, a voltage may be applied to gate zero. As shown by the FIG. 3C, in order to achieve the reordered sequence of rows (0,2; 1,3), a voltage may be applied to gate zero, followed by gate two, gate one, and gate three.

The voltage settings for the data lines illustrated in FIG. 3B may then be set according to the voltage setting of Vcom over time (as shown in FIG. 3A) and the order in which the rows are gated (as shown in FIG. 3C). The relative voltage between a pixel electrode 202 and a common electrode 206 at a particular instant in time is shown in FIG. 3D and FIG. 3E, which is a diagram illustrating a set of waveforms associated with black and white sub-pixels. The relative voltage for a sub-pixel after a particular row has been gated is given as the difference between the voltage level the corresponding data line minus the voltage level of $V_{com}$. For example, after row one has been gated, the relative voltage for a white sub-pixel may be 1.0 volt minus 4.5 volts=−3.5 volts.

As FIGS. 3A-3E illustrate, the $V_{com}$ inversion frequency of a two row method of reordered inversion can be the same frequency as that associated with conventional two row inversion. Thus, the amount of power necessary to implement two row reordered inversion can be comparable to that of conventional two row inversion. However, the amount of perceptible flicker may approximate that of conventional one row inversion since adjacent rows of pixels are never updated during the same transition of $V_{com}$.

The net effect of this inversion scheme is that for each video frame, the even rows may still present a different level of brightness than the odd rows, thus mitigating the effects of flicker in a manner comparable to that of conventional one row inversion. This is best demonstrated in FIG. 3F, which is a table containing the relative voltages of pixels for each of the four rows of the liquid crystal display panel. Note that these voltages are numeric representations of the relative voltage waveforms shown in FIG. 3D and FIG. 3E, which can be derived as the difference between the voltage level of $V_{com}$ and the voltage level applied to a corresponding data line 110 after a particular row has been gated.

By selecting update sets of even rows or odd rows, clusters of adjacent rows are therefore not readily perceived as becoming brighter or darker simultaneously. At the same time, the frequency of $V_{com}$ may be reduced to a level that is one-half as large as the frequency associated with conventional one row inversion. This results in a smaller power output since current is directly related to frequency, and power is directly related to current (as already stated above).

FIGS. 4A-4D are tables of row update sequences and corresponding $V_{com}$ voltage settings which together illustrate how the aforementioned process of two row reordered inversion may be extended according to embodiments of the present disclosure. FIG. 4A is a table illustrating conventional one row inversion. FIG. 4B illustrates two row reordered inversion, FIG. 4C illustrates four row reordered inversion, while FIG. 4D illustrates eight row reordered inversion. The top portion of each table denotes the voltage setting of $V_{com}$ as a function of time, while the bottom portion contains an index of the present row of pixels being updated. Note that while sixteen rows are illustrated within each table (i.e., rows 0-15), the actual number of rows within a display panel may be substantially larger, but the order of row updates will still generally follow the same pattern as illustrated within the tables.

The methods of reordered inversion associated with the sequences shown in FIGS. 4B-4D may be implemented in a number of ways. For example, in some embodiments, each row of pixels in the display panel may be assigned to an update set so that each row in the set is separated by at least one row. A common voltage applied to a set of electrodes within the display panel may be switched between two voltage levels at a constant frequency. The rows existing within an update set may then be updated with each transition of the common voltage.

FIG. 4B illustrates an exemplary sequence of two row reordered inversion according to embodiments of the disclosure. As shown by FIG. 4B, the number of $V_{com}$ transitions (eight) may be one-half the number of $V_{com}$ transitions utilized in conventional one row inversion (sixteen, as shown in FIG. 4A). Likewise, the number of rows within an update set may be double the number of rows updated in conventional one row inversion.

FIG. 4C illustrates an exemplary sequence of four row reordered inversion according to embodiments of the disclosure. As shown by FIG. 4C, the number of $V_{com}$ transitions (four) may be one-fourth the number of $V_{com}$ transitions as conventional one row inversion (sixteen). Likewise, the number of rows within an update set may be four times the number of rows updated in conventional one row inversion.

FIG. 4D illustrates an exemplary sequence of eight row reordered inversion according to embodiments of the disclosure. As shown by FIG. 4D, the number of $V_{com}$ transitions (two) may be one-eighth the number of $V_{com}$ transitions as conventional one row inversion (sixteen). Likewise, the number of rows within an update set may be eight times the number of rows updated in conventional one row inversion.

As shown by FIGS. 4B-4D, as the frequency of $V_{com}$ is halved, the number of rows in each update set may double. Since current is directly related to frequency and power is directly related to current, as the frequency of $V_{com}$ becomes progressively smaller, the amount of power necessary to drive the display also becomes progressively smaller.

According to one embodiment, all of the even rows may be updated before $V_{com}$ is switched, followed by updates to all of the odd rows. In many cases, this setting provides the minimal frequency of $V_{com}$ which still preserves the characteristics of flicker associated with conventional one row inversion.

It should be noted, however, that an undesirable image effect known as "frame tearing" can become more perceptible as the update set becomes progressively larger. Frame tearing may cause portions of a discrete image presented upon the display over two successive frames to appear in separate locations at the same time. Since both the level of perceptible tear and the time at which a torn image remains on the screen depend upon the number of rows within the update set, some embodiments of the present disclosure update anywhere from eight to sixty-four rows in order to balance power savings with high visual quality.

In order modify the gate pulse sequence and the row update sequence so that reordered row inversion can be implemented, a number of techniques may be utilized according to embodiments of the present disclosure. For example, the gate pulse sequence can be reordered within a liquid crystal display driver chip or via gate driver circuits disposed upon an electrically insulative substrate (e.g., glass) without a significant area or performance penalty.

According to some embodiments, the row update sequence can be reordered within a liquid crystal display driver chip after that sequence has been sequentially transmitted from a host video driver. In some embodiments, the liquid crystal display driver chip may utilize a partial frame buffer in order to accomplish this reordering. In one embodiment, for example, the partial frame buffer contains a memory size corresponding to the number of rows within an update set.

In other embodiments, the row update sequence can be reordered within the host video driver itself. The host video driver can then transmit the reordered sequence of row updates to the liquid crystal display driver. In this manner, the logic contained within the liquid crystal display driver chip can be largely insulated from the reordering process. Additionally, the liquid crystal display driver chip may not require additional memory, thereby resulting in a cost savings.

Figure 5:
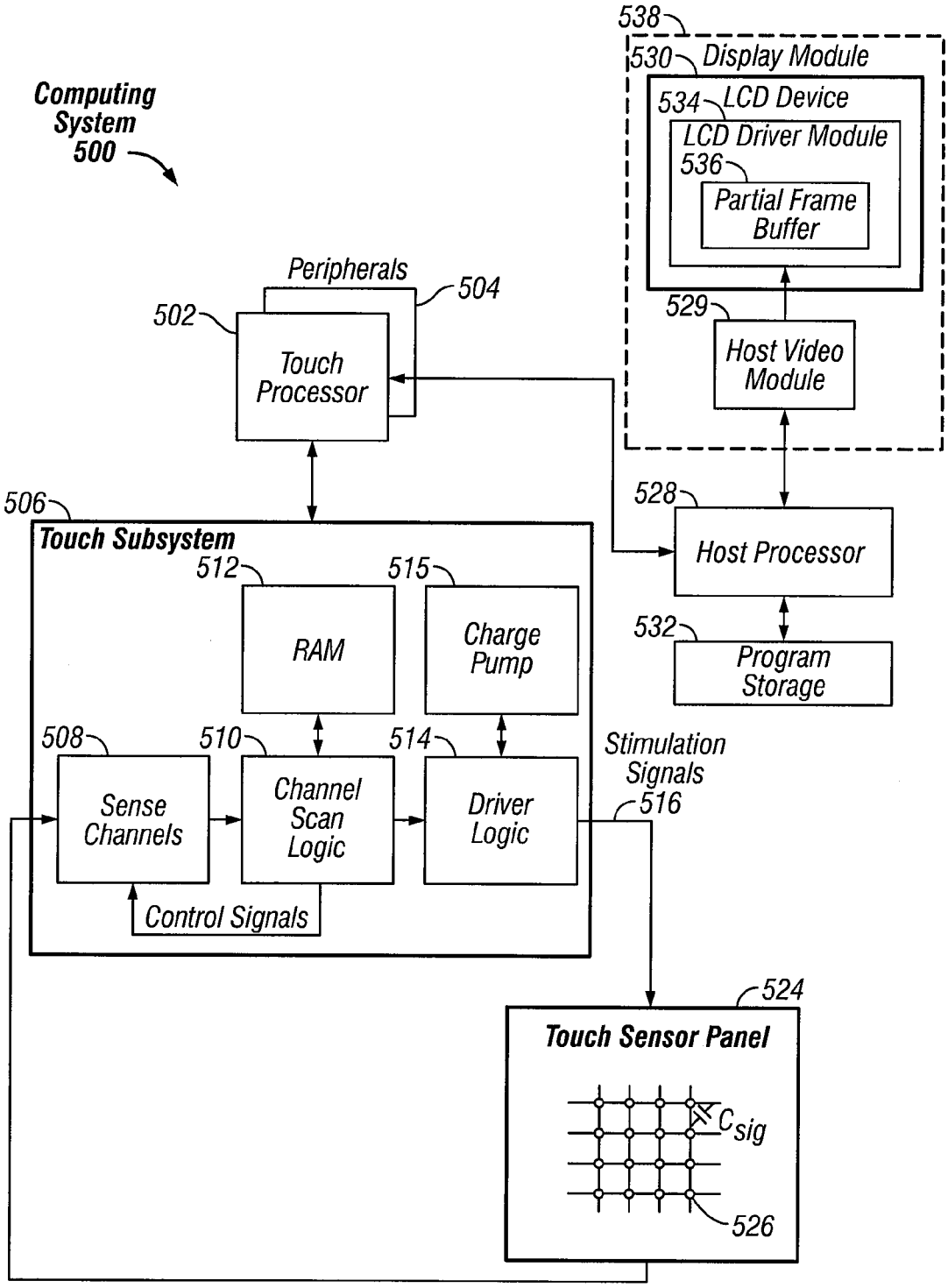
FIG. 5 illustrates an exemplary computing system including a touch sensor panel and a display module utilizing reordered inversion according to embodiments of the disclosure.

FIG. 5 illustrates exemplary computing system 500 including a touch sensor panel 524 and a display module 538 that can include one or more of the embodiments of the disclosure described above. With respect to touch sensing functionality, exemplary computing system 500 can include one or more touch processors 502 and peripherals 504, and touch subsystem 506. Peripherals 504 can include, but are not limited to, random access memory (RAM) or other types of memory or storage, watchdog timers and the like. Touch subsystem 506 can include, but is not limited to, one or more sense channels 508, channel scan logic 510 and driver logic 514. Channel scan logic 510 can access RAM 512, autonomously read data from the sense channels and provide control for the sense channels. In addition, channel scan logic 510 can control driver logic 514 to generate stimulation signals 516 at various frequencies and phases that can be selectively applied to drive lines of touch sensor panel 524. In some embodiments, touch subsystem 506, touch processor 502 and peripherals 504 can be integrated into a single application specific integrated circuit (ASIC).

Touch sensor panel 524 can include a capacitive sensing medium having a plurality of drive lines and a plurality of sense lines, although other sensing media can also be used. Each intersection of drive and sense lines can represent a capacitive sensing node and can be viewed as touch pixel 526, which can be particularly useful when touch sensor panel 524 is viewed as capturing an "image" of touch. (In other words, after panel subsystem 506 has determined whether a touch event has been detected at each touch sensor in the touch sensor panel, the pattern of touch sensors in the multi-touch panel at which a touch event occurred can be viewed as an "image" of touch (e.g. a pattern of fingers touching the panel).) Each sense line of touch sensor panel 524 can drive sense channel 508 (also referred to herein as an event detection and demodulation circuit) in touch subsystem 506.

Computing system 500 can also include host processor 528 for receiving outputs from touch processor 502 and performing actions based on the outputs that can include, but are not limited to, moving an object such as a cursor or pointer, scrolling or panning, adjusting control settings, opening a file or document, viewing a menu, making a selection, executing instructions, operating a peripheral device coupled to the host device, answering a telephone call, placing a telephone call, terminating a telephone call, changing the volume or audio settings, storing information related to telephone communications such as addresses, frequently dialed numbers, received calls, missed calls, logging onto a computer or a computer network, permitting authorized individuals access to restricted areas of the computer or computer network, loading a user profile associated with a user's preferred arrangement of the computer desktop, permitting access to web content, launching a particular program, encrypting or decoding a message, and/or the like. Host processor 528 can also perform additional functions that may not be related to touch panel processing, and can be coupled to program storage 532 and display module 538. When located partially or entirely under the touch sensor panel 524, liquid crystal display device 530 together with touch sensor panel 524 can form a touch screen.

Note that one or more of the functions described above can be performed by firmware stored in memory (e.g. one of the peripherals 504 in FIG. 5) and executed by panel processor 502, or stored in program storage 532 and executed by host processor 528. The firmware can also be stored and/or transported within any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any medium that can contain or store the program for use by or in connection with the instruction execution system, apparatus, or device. The computer readable medium can include, but is not limited to, an electronic, magnetic, optical, electromagnetic, infrared, or semiconductor system, apparatus or device, a portable computer diskette (magnetic), a random access memory (RAM) (magnetic), a read-only memory (ROM) (magnetic), an erasable programmable read-only memory (EPROM) (magnetic), a portable optical disc such a CD, CD-R, CD-RW, DVD, DVD-R, or DVD-RW, or flash memory such as compact flash cards, secured digital cards, USB memory devices, memory sticks, and the like.

The firmware can also be propagated within any transport medium for use by or in connection with an instruction execution system, apparatus, or device, such as a computer-based system, processor-containing system, or other system that can fetch the instructions from the instruction execution system, apparatus, or device and execute the instructions. In the context of this document, a "transport medium" can be any medium that can communicate, propagate or transport the program for use by or in connection with the instruction execution system, apparatus, or device. The transport readable medium can include, but is not limited to, an electronic, magnetic, optical, electromagnetic or infrared wired or wireless propagation medium.

With respect to display functionality, display module 538 can include host video module 529 adapted to stream a video feed to liquid crystal device 530. The video feed may be received by a liquid crystal display driver module 534 resident within the liquid crystal display device 530.

According to some embodiments, host video module 529 may output signals corresponding to row updates such that the rows are updated sequentially. The liquid crystal display driver module 534, upon receiving these signals, may then reorder the sequence in the manner described above. In some embodiments (such as that depicted by FIG. 5), the liquid crystal display driver module may contain a partial frame buffer for temporarily storing out-of-sequence signaling data.

In other embodiments, reordering logic may be contained within host video module 529, where host video module 529 may present a reordered video feed to the liquid crystal display driver module 534. In still other embodiments, host video module 529 may be adapted to initially output a designated row update sequence, thereby obviating the need for reordering logic.

Figure 6:
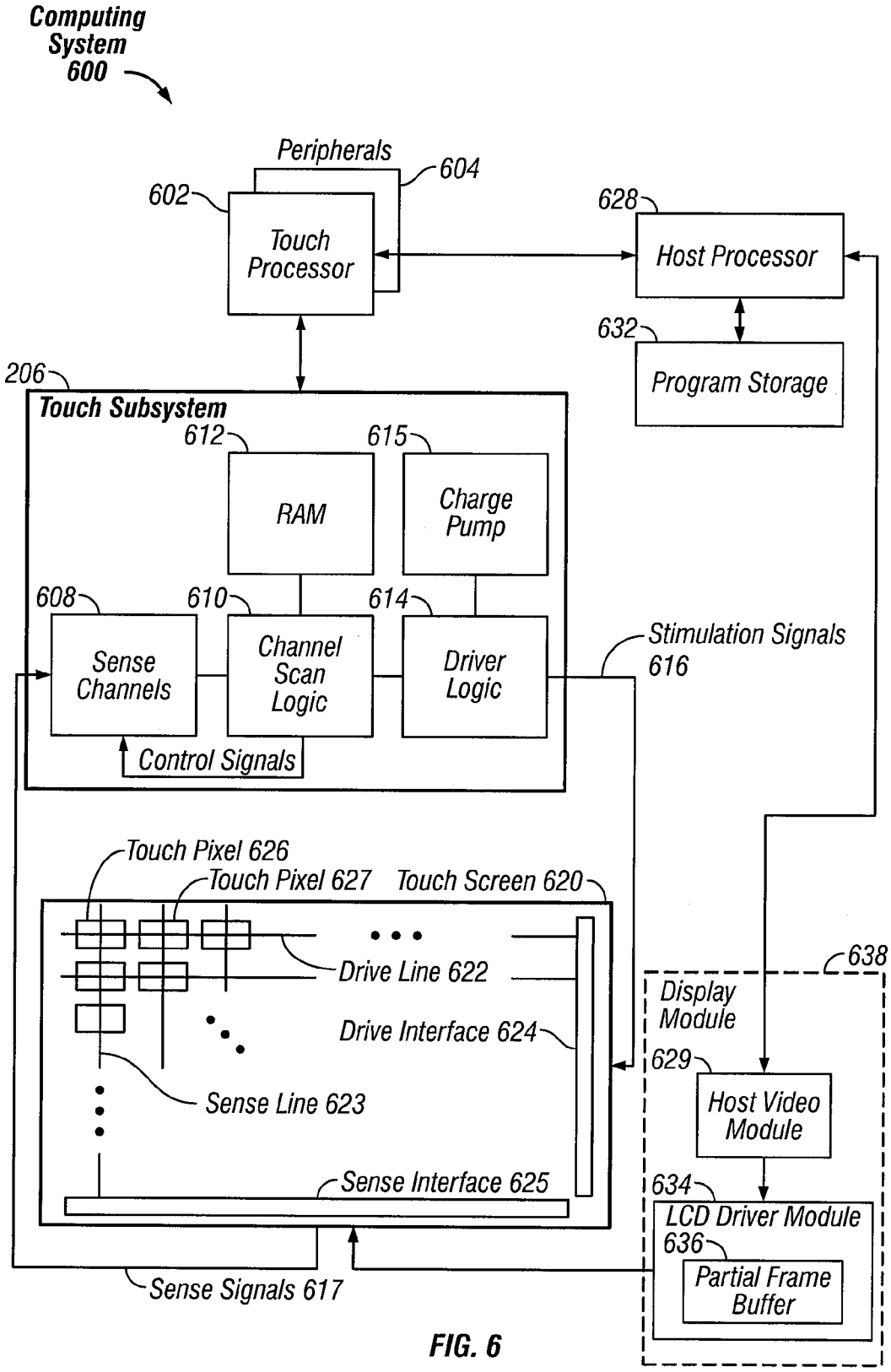
FIG. 6 illustrates an exemplary computing system including a touch screen utilizing reordered inversion according to embodiments of the disclosure.

In some embodiments, the display and touch sensing functionality may be integrated so that at least a portion of the pixels 102 may be adapted to function as capacitive touch sensors within a touch sensor panel. For instance, FIG. 6 is a block diagram of an exemplary computing system 600 including a touch screen 620 utilizing reordered inversion according to embodiments of the disclosure.

Touch screen 620 can include a capacitive sensing medium having a plurality of drive lines 622 and a plurality of sense lines 623. Drive lines 622 can be driven by stimulation signals 616 from driver logic 614 through a drive interface 624, and resulting sense signals 617 generated in sense lines 623 are transmitted through a sense interface 625 to sense channels 608 (also referred to as an event detection and demodulation circuit) in touch subsystem 606. Since signals 617 can carry touch information resulting from interaction of a touch object on or near touch screen 620 with the drive and sense lines. In this way, drive lines and sense lines can interact to form capacitive sensing nodes such as touch pixels 626 and 627.

Figure 7:
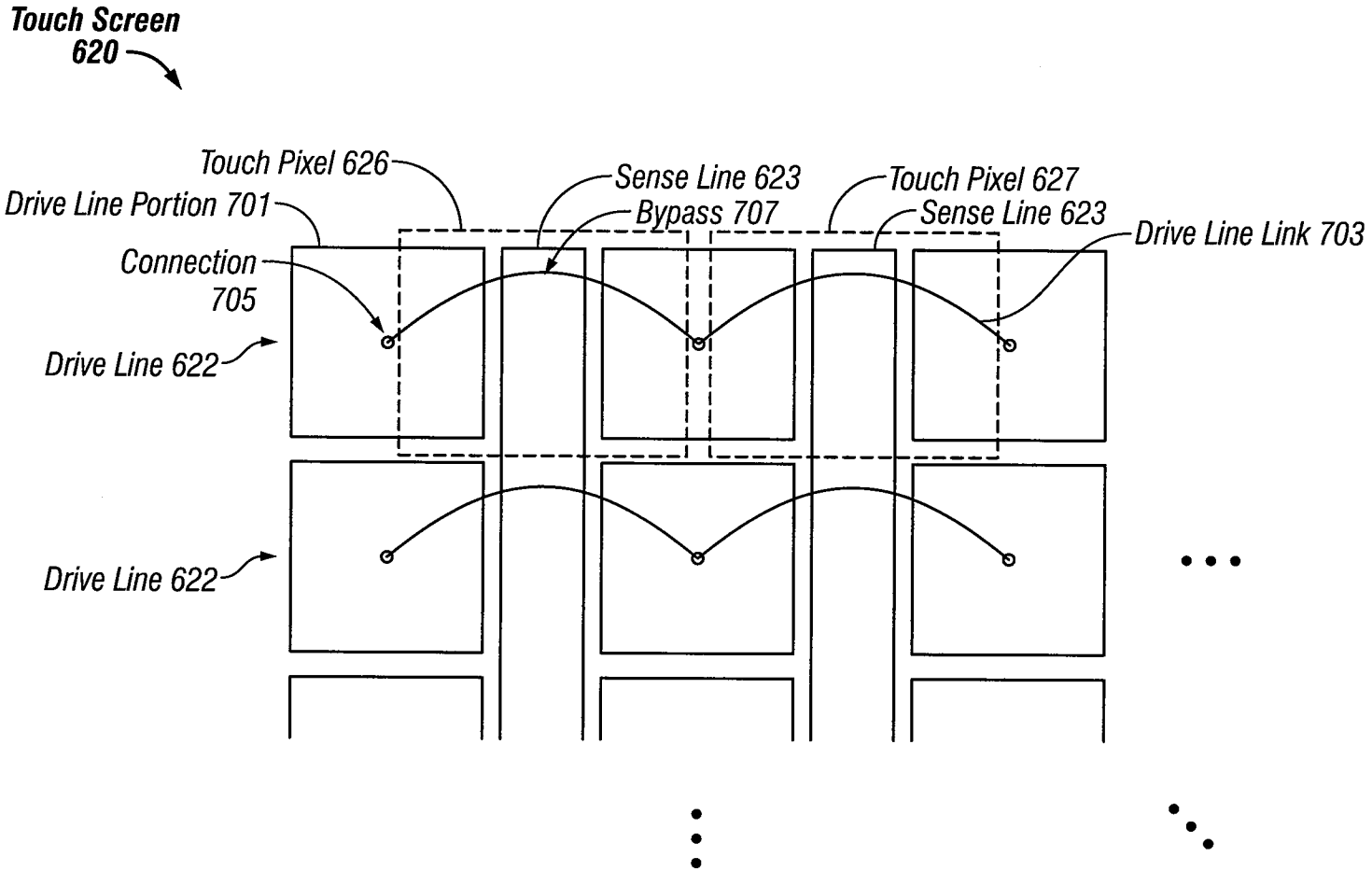
FIG. 7 illustrates a portion of an example touch screen utilizing reordered inversion according to embodiments of the disclosure.

FIG. 7 is a more detailed view of touch screen 620 showing an example configuration of drive lines 622 and sense lines 623 according to embodiments of the disclosure. As shown in FIG. 7, each drive line 622 is formed of multiple drive line portions 701 electrically connected by drive line links 703 at connections 705. Drive line links 703 may not be electrically connected to sense lines 623; rather, the drive line links may bypass the sense lines through bypasses 707. Drive lines 622 and sense lines 623 may interact capacitively to form touch pixels such as touch pixels 626 and 627. Drive lines 622 (i.e., drive line portions 701 and drive line links 703) and sense lines 623 can be formed of electrically conductive structures in touch screen 620.

Figure 8:
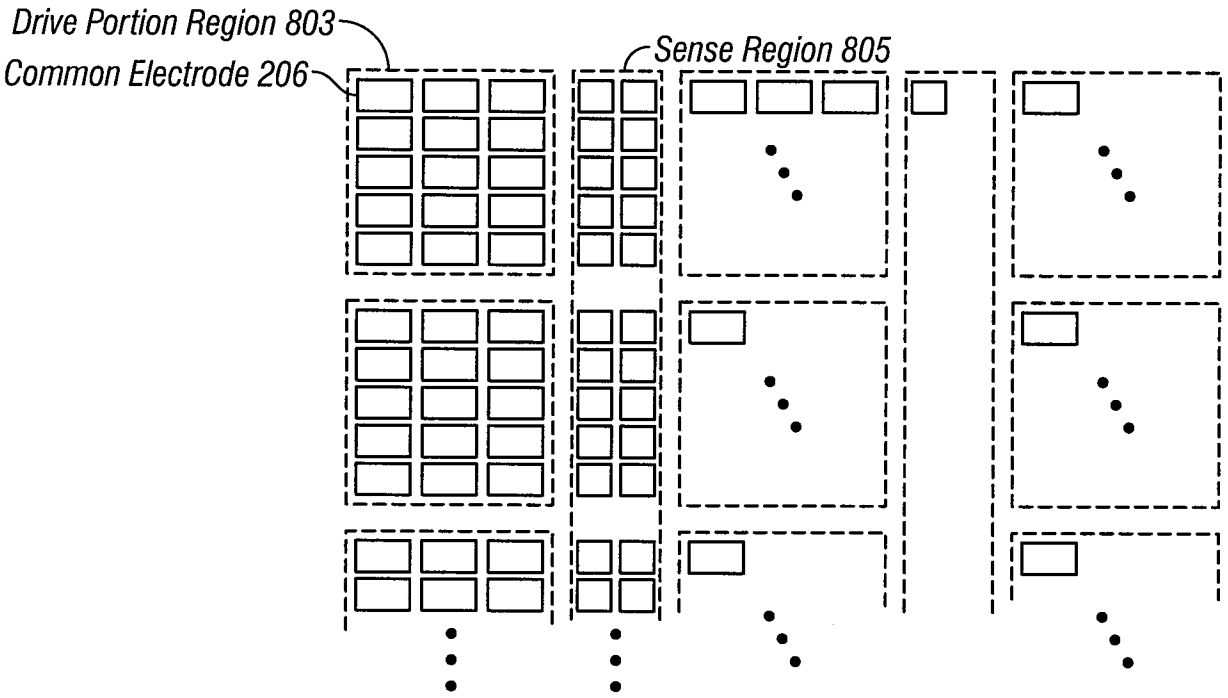
FIG. 8 illustrates a portion of another example touch screen utilizing reordered inversion according to embodiments of the disclosure.

The electrically conductive structures can include, for example, structures that exist in conventional liquid crystal displays. FIG. 8 illustrates an example configuration in which common electrodes 206 are grouped to form portions of a touch sensing system according to embodiments of the disclosure. The common electrodes 206 may be formed of a semitransparent conductive material such as indium tin oxide. In this example, common electrodes 206 operate like common electrodes of a conventional fast field switching (FFS) display during a display phase of touch screen 620 to display an image on the touch screen. During a touch phase, common electrodes 206 may be grouped together to form drive portion regions 803 and sense regions 805 corresponding to drive line portions 701 and sense lines 623 of touch screen 620.

Figure 9:
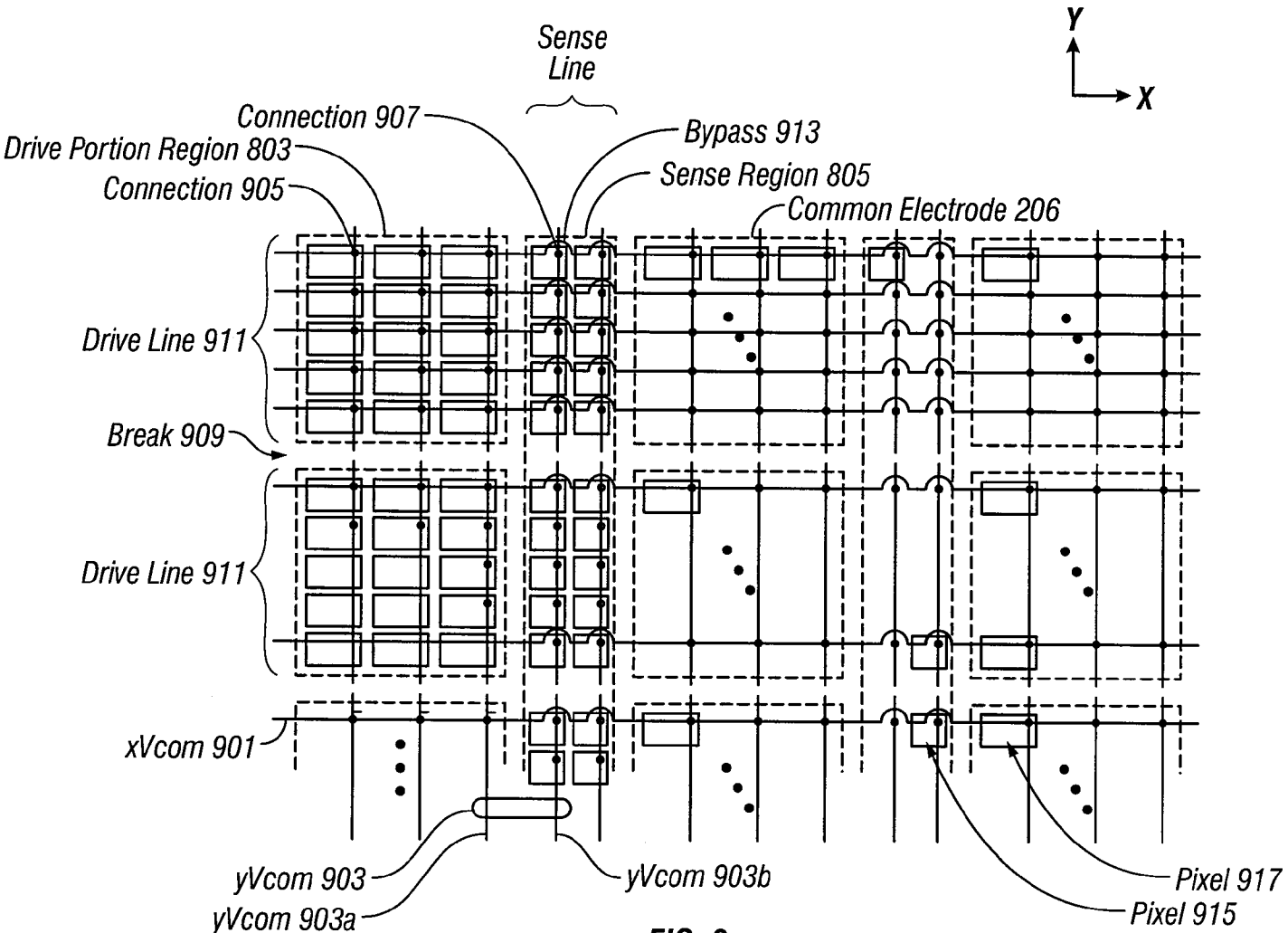
FIG. 9 illustrates further details of the exemplary touch screen of FIG. 8 according to embodiments of the present disclosure.

FIG. 9 illustrates an example configuration of conductive lines that can be used to group common electrodes 206 into the configuration shown in FIG. 8 and to link drive portion regions to form drive lines according to embodiments of the disclosure. FIG. 9 includes $xV_{com}$ lines 801 along the x-direction and $yV_{com}$ lines 903 along the y-direction. Each drive portion region 803 may be formed as a group of common electrodes 801 connected together through connections 905, which may connect each common electrode to one of the xVcom lines 901 and to one of the $yV_{com}$ lines 903 in the drive portion region, as described in more detail below. The $yV_{com}$ lines 903 running through the drive portion regions 803, such as $yV_{com}$ line 903*a*, may include breaks 909 that provide electrical separation of each drive portion region from other drive portion regions above and below.

Each sense region 805 may be formed as a group of common electrodes 206 connected together through connections 907, which may connect each common electrode to one of the $yV_{com}$ lines 903. Additional connections (not shown) may connect together the $yV_{com}$ lines of each sense region 805. For example, the additional connections can include switches in the border of touch screen 620 that connect the $yV_{com}$ lines of each sense region during the touch phase of operation. The $yV_{com}$ lines 903 running through the sense regions 805, such as $yV_{com}$ line 903*b*, may electrically connect all of the common electrodes 801 in the y-direction; therefore, the $yV_{com}$ lines of the sense regions do not include breaks.

Drive lines 911 may be formed by connecting drive portion regions 803 across sense regions 805 using $xV_{com}$ lines 901. The $xV_{com}$ lines may bypass the $yV_{com}$ lines in the sense region using bypasses 913.

Figure 10:
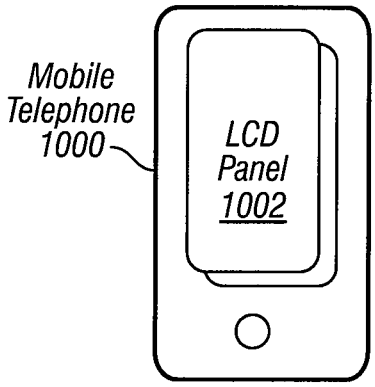
FIG. 10 illustrates an example mobile telephone that can include a liquid crystal display panel utilizing reordered row inversion according to embodiments of the present disclosure.
Figure 11:
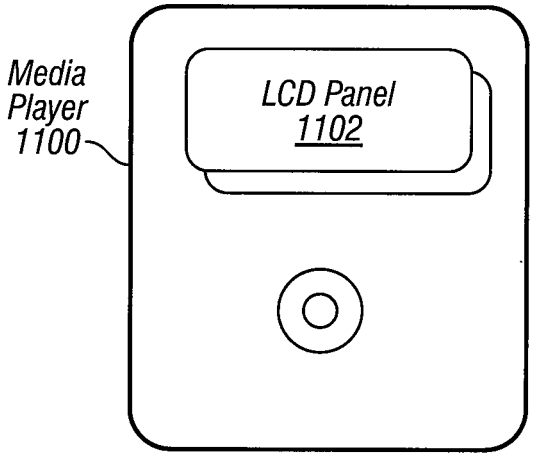
FIG. 11 illustrates an example digital media player that can include a liquid crystal display panel utilizing reordered row inversion according to embodiments of the present disclosure.
Figure 12:
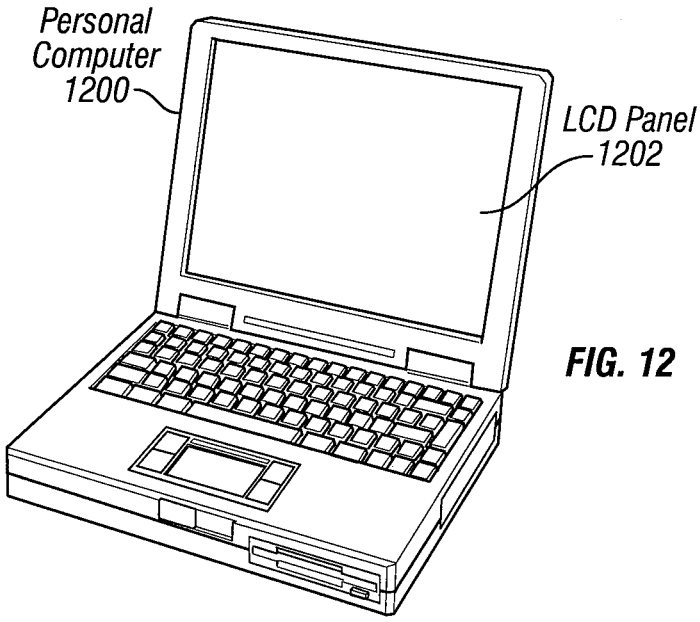
FIG. 12 illustrates an example personal computer that can include a liquid crystal display panel utilizing reordered row inversion according to embodiments of the present disclosure.

It is important to note that embodiments of the disclosure may be utilized within a wide variety of electronic devices. For example, FIG. 10 illustrates a mobile telephone 1000 that can include a liquid crystal display panel 1002 utilizing reordered row inversion according to one embodiment of the present disclosure. FIG. 11 illustrates an example digital media player 1100 that can include a liquid crystal display panel 1102 utilizing reordered row inversion according to another embodiment of the present disclosure. FIG. 12 illustrates an example personal computer 1200 that can include a liquid crystal display panel 1202 according to still another embodiment of the present disclosure. Various other electronic devices are also contemplated as being within the scope of the present disclosure.

Although embodiments of this disclosure have been fully described with reference to the accompanying drawings, it is to be noted that various changes and modifications will become apparent to those skilled in the art. Such changes and modifications are to be understood as being included within the scope of embodiments of this disclosure as defined by the appended claims.

What is claimed is:

1. A method of updating rows of pixels in a display panel, the method comprising:

assigning rows of pixels in the display panel to one of a plurality of update sets, each update set including a sequence of rows such that each row in the sequence is separated from a next row in the sequence by at least one row;

applying a common voltage to a set of electrodes in the display panel, the common voltage adapted to switch between two voltage levels; and updating the pixels in the rows of an update set each time the common voltage applied to the set of electrodes switches voltage levels, wherein at least one row in one of the plurality of update sets updates before another row in the same update set updates a second time.

2. The method of claim 1, each update set having a same number of rows.

3. The method of claim 1, each update set including a sequence of either all even rows or all odd rows.

4. The method of claim 3, further comprising:

assigning only first and second update sets, each update set including a sequence of either all even rows or all odd rows; and updating the pixels in the rows of one update set before updating the pixels in the rows of the other update set.

5. The method of claim 1, further comprising updating the pixels in the rows of an update set by modifying a gate pulse sequence of the display panel.

6. The method of claim 5, further comprising modifying the gate pulse sequence within a display driver chip.

7. The method of claim 5, further comprising modifying the gate pulse sequence via a gate driver circuit.

8. A display apparatus, comprising:

one or more display driver circuits communicatively couplable to an array of display pixels in a display panel, the one or more display driver circuits capable of assigning rows of pixels in the display panel to one of a plurality of update sets, each update set including a sequence of rows such that each row in the sequence is separated from a next row in the sequence by at least one row, applying a common voltage to a set of electrodes in the display panel, the applied voltage adapted to switch between two voltage levels, and updating the pixels in the rows of an update set each time the voltage applied to the electrodes switches voltage levels, wherein at least one row in one of the plurality of update sets updates before another row in the same update set updates a second time.

9. The display apparatus of claim 8, the one or more display driver circuits further configured for assigning the rows of pixels in the display panel to one of a plurality of update sets such that each update set has a same number of rows.

10. The display apparatus of claim 8, the one or more display driver circuits further configured for assigning the rows of pixels in the display panel to one of a plurality of update sets such that each update set includes a sequence of either all even rows or all odd rows.

11. The display apparatus of claim 10, the one or more display driver circuits further configured for:

assigning only first and second update sets, each update set including a sequence of either all even rows or all odd rows; and updating the pixels in the rows of one update set before updating the pixels in the rows of the other update set.

12. The display apparatus of claim 8, the one or more display driver circuits further configured for updating the pixels in the rows of an update set by modifying a gate pulse sequence of the display panel.

13. The display apparatus of claim 12, the one or more display driver circuits further configured for modifying the gate pulse sequence within a display driver chip.

14. The display apparatus of claim 12, the one or more display driver circuits further configured for modifying the gate pulse sequence via a gate driver circuit.

15. The display apparatus of claim 8, the one or more display driver circuits further comprising a set of gate driver circuits disposed upon an electrically insulative substrate.

16. The display apparatus of claim 8, further comprising:

the display panel communicatively coupled to the one or more display driver circuits, the display panel including the array of pixels arranged into a plurality of rows, each pixel including a common electrode and an individually addressable pixel electrode, the common electrodes tied to a common alternating voltage source.

17. The display apparatus of claim 16, wherein at least a portion of the array of pixels are adapted to function as capacitive touch sensors in a touch sensor panel.

18. The display apparatus of claim 17, wherein the touch sensor panel is incorporated within a computing system.

19. The display apparatus of claim 16, wherein the common alternating voltage source is adapted to switch voltages at a constant frequency, and wherein the frequency is selected so as to attain a desired level of image quality.

* * * * *